US009656152B2

(12) United States Patent
Steele

(10) Patent No.: US 9,656,152 B2
(45) **Date of Patent: *May 23, 2017**

(54) SLING CARRIER FOR SKIS, SNOWBOARD AND BOOTS

(71) Applicant: Devin Steele, Big Bear Lake, CA (US)

(72) Inventor: Devin Steele, Big Bear Lake, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/877,062

(22) Filed: Oct. 7, 2015

(65) Prior Publication Data

US 2016/0101344 A1 Apr. 14, 2016

Related U.S. Application Data

(63) Continuation-in-part of application No. 14/510,014, filed on Oct. 8, 2014.

(51) Int. Cl.

| | |
|---|---|
| ***A45F 3/04*** | (2006.01) |
| ***A63C 11/02*** | (2006.01) |
| ***A45F 3/14*** | (2006.01) |
| ***A45F 4/00*** | (2006.01) |

(52) U.S. Cl.

CPC ..... *A63C 11/025* (2013.01); *A45F 3/04* (2013.01); *A45F 3/14* (2013.01); *A45F 4/00* (2013.01); *A45F 2003/142* (2013.01); *A45F 2004/006* (2013.01)

(58) Field of Classification Search

CPC ..... A45F 3/02; A45F 3/04; A45F 3/14; A45F 2003/142; A45F 2003/003; A63C 11/023; A63C 11/025

USPC ..... 224/917, 250; 211/70.5; 280/819–820

See application file for complete search history.

(56) References Cited

U.S. PATENT DOCUMENTS

| | | | | | |
|---|---|---|---|---|---|
| 4,488,748 | A | * | 12/1984 | Burkes | A63C 11/025 294/147 |
| 4,852,931 | A | | 8/1989 | Ferdi | |
| 4,903,875 | A | * | 2/1990 | Smart | A63C 11/025 224/149 |
| 4,982,883 | A | * | 1/1991 | Ullal | A45F 3/14 224/643 |
| 5,104,017 | A | * | 4/1992 | Vandagriff | A63C 11/025 224/250 |
| 5,160,074 | A | | 11/1992 | Coates | |
| 5,344,056 | A | * | 9/1994 | Challoner | A63C 17/00 224/581 |
| 5,350,096 | A | | 9/1994 | Sieber | |

(Continued)

*Primary Examiner* — Justin Larson
*Assistant Examiner* — Phillip Schmidt
(74) *Attorney, Agent, or Firm* — Kirk A. Buhler; Buhler & Associates

(57) ABSTRACT

Improvements in a sling carrier for skis, snowboard and boots to be able to carry the skies and or snowboard across the back of the wearer is disclosed. The ability to sling the equipment over the back of a user allows the user to have full mobility walk. A user can tighten the sling to adjust the location of the equipment in their back. Having the equipment supported on their back allows the user to walk in a more balanced stance and the user just needs to bend forward or backward to accommodate the load or the terrain. The carrier uses pockets for the equipment and for transportation of the carrier equipment. This also leave the hand of the user free while transporting equipment. The carrier uses Buckles that allow the user to just "squeeze" elements together to release the straps.

10 Claims, 11 Drawing Sheets

(56) References Cited

U.S. PATENT DOCUMENTS

| | | | | | |
|---|---|---|---|---|---|
| 5,370,286 | A * | 12/1994 | Newman | A45F 3/14 | 119/857 |
| 5,383,587 | A * | 1/1995 | Carpenter | A63C 11/02 | 224/200 |
| 5,400,937 | A * | 3/1995 | Rottenberg | A63C 11/025 | 224/257 |
| 5,425,485 | A * | 6/1995 | Carlo | A45F 3/14 | 224/250 |
| D378,245 | S | 3/1997 | DeMier | | |
| 5,746,361 | A | 5/1998 | Johnson | | |
| 5,762,242 | A * | 6/1998 | Yost | A63C 11/025 | 224/250 |
| 5,908,206 | A | 6/1999 | LoPresti, Jr. | | |
| 5,950,893 | A * | 9/1999 | Heggeland | A45C 13/26 | 150/107 |
| 6,021,937 | A | 2/2000 | Schryver | | |
| 6,457,762 | B1 | 10/2002 | Garutti | | |
| 6,672,495 | B2 | 1/2004 | Sagan | | |
| 6,799,707 | B2 | 10/2004 | Gibson | | |
| 2002/0175098 | A1* | 11/2002 | Mauch | A63B 55/00 | 206/315.3 |
| 2005/0067450 | A1* | 3/2005 | Trejo | A45F 3/08 | 224/259 |
| 2007/0210570 | A1 | 9/2007 | Erichsen | | |
| 2010/0206930 | A1 | 8/2010 | Sims | | |
| 2014/0361059 | A1* | 12/2014 | Fuller, Sr. | A45F 5/00 | 224/267 |
| 2015/0359320 | A1* | 12/2015 | Phan | A45F 3/14 | 224/257 |

* cited by examiner

SLING CARRIER FOR SKIS, SNOWBOARD AND BOOTS

CROSS REFERENCE TO RELATED APPLICATION

This application is a continuation-in-part of applicant's co-pending application Ser. No. 14/510,014 filed Oct. 8, 2014 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a device to carrying elongated objects. More particularly, the present Sling Carrier for Skis, Snowboard and Boots creates a method to carry skis and/or snowboard with boots. The sling carrier provides full mobility for the person carrying the sporting equipment.

Description of Related Art Including Information Disclosed Under 37 CFR 1.97 and 1.98

For many people that participate in outdoor winter sports, must carry their equipment from a car or ski rental location to the lift line. When a person carries the equipment to the ski lift, the person must carry the equipment to the ski lift and then the person must place the equipment onto themselves for skiing or snowboarding. Most outdoor winter athletes either ski or snowboard, but some of these athletes perform both sports and must carry a large amount of equipment to the ski lift or to a place where instruction will take place.

There are a number of different ways to carry ski and snowboard equipment. Without any external carrying equipment the person generally walks with the boots on and carries the ski/snowboard and possibly poles. A second alternative was to have some sort of external device that allows a person to carry the ski or snowboard equipment. There are a large number of variation for carrying the equipment in one hand or on their body. A number of patents and or publications have been made to address these issues. Exemplary examples of patents and or publication that try to address this/these problem(s) are identified and discussed below.

U.S. Pat. No. 5,383,587 issue to Gary L. Carpenter issued on Jan. 24, 1995 to Gary L. Carpenter discloses a Device for Carrying Elongated Ski Equipment. This patent has a pocket where the end of the skies are placed, and a strap that connects from the pocket to an upper end of the skies. The strap is placed over a shoulder so the skies are slung from behind the person and under a shoulder to a position in front of the person and must be carried with at least one hand. With this configuration the person can't bend down or forward without the skies touching the ground. The patent further does not allow the person to transport the ski boots with the skies because the ski boots will occupy an area of the person transporting the equipment.

U.S. Pat. No. 6,672,495 issued on Jan. 6, 2004 discloses a Bifurcated Carrier Pack for Transporting Recreational Equipment. The patent allows the person to transport a snowboard across the back of the user. With this embodiment the person can bend over, but the orientation of the snowboard makes it difficult to move through a door, and the straps make transportation of the boots difficult. The equipment further does not allow for transportation of skies.

U.S. Publication 2007/0210570 that was published on Sep. 13, 2007 for Jasper C. Erichsen discloses a Ski-Carrier. This publication is for an extendable belt mounted pocket. The pocket is secured onto a belt that holds the pants of a user. When a user wants to transport their skies they extend a pocket and slide the end of the skies into the pocket to support one end of the skies and holds the free end of the skies. Due to the orientation of the skies, the invention does not allow for transportation of the boots with the skies.

U.S. Publication 2010/0206930 that was published on Aug. 19, 2010 for Andrew Jason Sims discloses a Ski and Snowboard Sling-belt. The belt slings the snowboard diagonally across the back of the user. While this patent allows for transportation of ski equipment it only allows for transportation of skies or a snowboard. After transportation the invention does not have a pocket or pouch to transport the carrier after use.

What is needed is a transportation device for a skies and/or snowboard along with the poles and boots. The transportation mechanism should further provide a storage mechanism for the transportation equipment. This document provides a solution.

BRIEF SUMMARY OF THE INVENTION

It is an object of the sling carrier for skis, snowboard and boots to be able to carry the skies and or snowboard across the back of the wearer. The ability to sling the equipment over the back of a user allows the user to have full mobility walk. A user can tighten the sling to adjust the location of the equipment in their back. Having the equipment supported on their back allows the user to walk in a more balanced stance and the user just needs to bend forward or backward to accommodate the load or the terrain.

It is an object of the sling carrier for skis, snowboard and boots to include a pocket for transportation of the skies and or snowboard. It is also a function of the carrier for the pocket to be used to store the transportation equipment and therefore allow the user to easily transport the equipment after the skies and or snowboard have been transported.

It is an object of the sling carrier for skis, snowboard and boots to be used for transportation of all the unique ski equipment. Along with the skies, one embodiment includes transportation of the ski poles and the boots. All of these pieces of equipment are slung over the back of the user and essentially leaves the hands free for paying for lift tickets, food or other items. This configuration also makes it possible for a person without limbs to transport the ski equipment by themselves, without requiring an additional person to transport the ski equipment.

It is an object of the sling carrier for skis, snowboard and boots to be used transportation of all the unique snowboard equipment. Along with the snowboard, one embodiment includes transportation of the snowboard and the boots. All of these pieces of equipment are slung over the back of the user and essentially leaves the hands free for paying for lift tickets, food or other items. This configuration also makes it possible for a person without limbs to transport the ski equipment by themselves, without requiring an additional person to transport the ski equipment.

It is another object of the sling carrier for skis, snowboard and boots to be used for transportation of all the unique ski equipment for a person that both skies and snowboards. Along with the skies and snowboard this embodiment includes transportation of the ski, snowboard, poles and either sets of boots. All of these pieces of equipment are slung over the back of the user and essentially leaves the hands free for paying for lift tickets, food or other items. This configuration also makes it possible for a person without limbs to transport the ski equipment by themselves, without requiring an additional person to transport the ski equipment.

It is still another object of the sling carrier for skis, snowboard and boots to use adjustable buckles to connect straps together. Buckles allow the user to just "squeeze" elements together to release the straps. For connecting elements together the user just pushes the parts together. This is especially important when it is cold and the user's fingers and hands are cold. This is also superior to hook-and-loop fasteners that become brittle and can become clogged with ice and snow thereby rendering them non-functional in cold weather.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
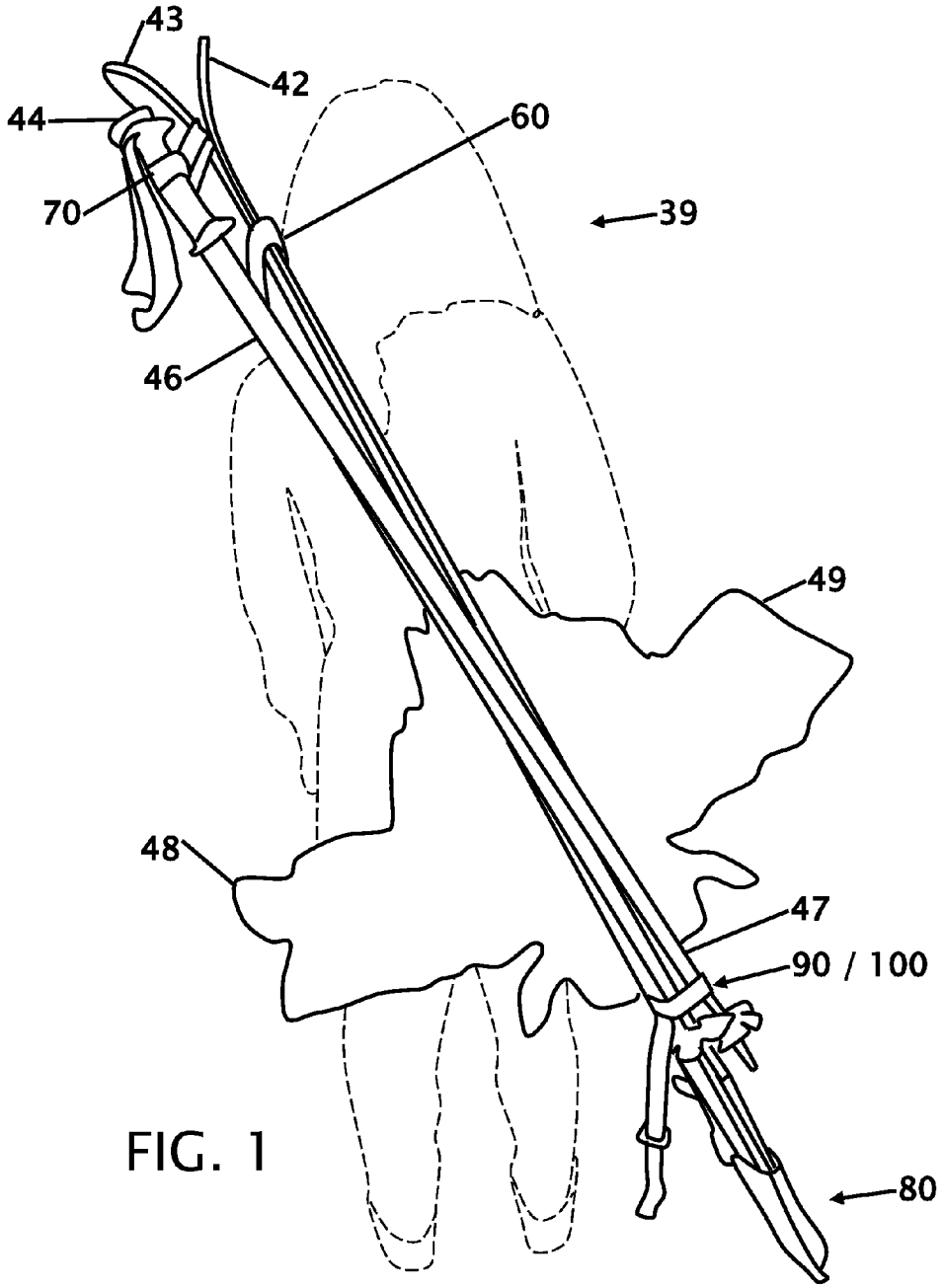
FIG. 1 shows a sling carrier for skies with attached boots.

FIG. 1 shows a sling carrier for skies with attached boots. In this figure the back of the user 39 is shown with the ski equipment slung over the back of the user in a diagonal orientation. In this orientation the user can bend forward and can walk with the weight of the equipment fairly evenly distributed on the user 39. The ski boots 48 and 49 are secured in the ski bindings 47, thereby no additional securing mechanism is required to retain the ski boots 48 and 49. While the ski boots 48 and 49 are shown secured into the ski bindings, the user can wear the ski boots 48 and 49 on their feet or can transport them on the skis as they transport the skies and ski poles slung over the back of the user.

The curved end of the skies 42 and 43 are secured together with an upper ski strap 60 that both secures the skies 42 and 43 together and provides an upper connection for a front sling (not shown in this figure). The upper end of the poles 46 and 47 (obscured in this figure) are connected together with an upper pole strap 30 that is secured to a "D" ring (obscured in this figure) that is secured around the skis, in this case, skis 42 and 43. The upper pole strap 30 is retained on the poles because the top of the ski poles include an enlarged top 44 to the hand grip portion of the pole(s). The flat under sides of the skies rest together and the bottom end of the ski poles are secured to the lower end of the skies 42 and 43 with a lower ski and pole strap 90/100. The flat end of the skies 42 and 43 and secured into a pouch 80.

Figure 2:
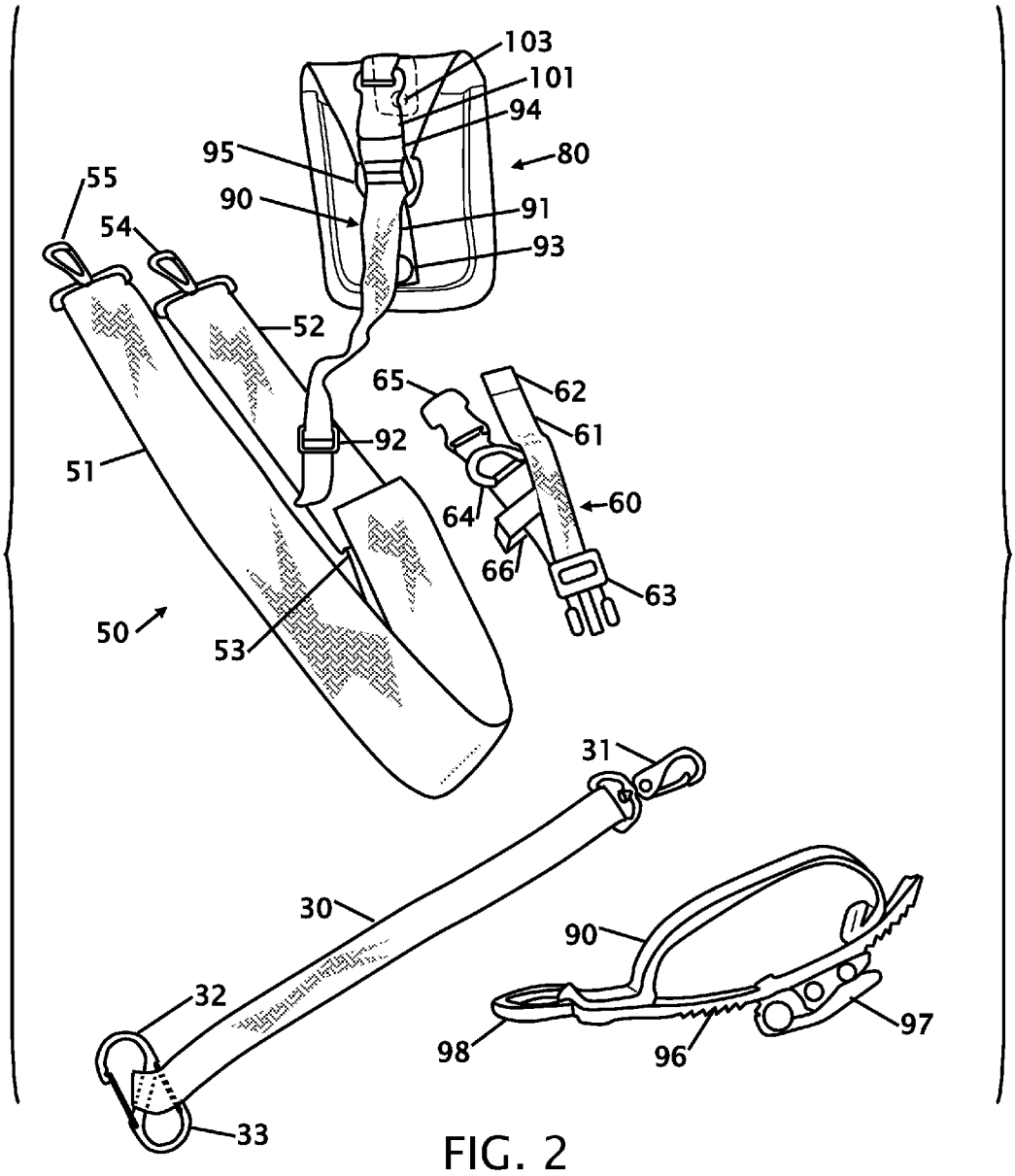
FIG. 2 shows a view of the components used in the sling carrier for skies.

FIG. 2 shows a view of the components used in the sling carrier for skies. These are the components that are used to transport the skies, boots and pole. The lower ski and pole straps 90 and 100 can be placed within the ski pouch 80 and all the components can be carried by the user as a complete unit. This will be shown and described in other figures herein.

The sling strap 50 has a separable buckle 53 with a male and a female clasp that allows a user to separate the two parts, 51 and 52, of the sling strap 50. The separable buckle 53 further includes an adjustment mechanism to alter the overall length of the sling strap to fit the geometry of a user to adjust the location of the equipment on the back of a user. On the opposing sides of the buckle 53 there are separate lengths of straps 51 and 52. Each of these lengths of straps terminate with operable clasps 54 and 55. The clasps 54 and 55, along with the buckle 53 are designed to allow an operator to connect and disconnect the components in freezing condition and with limited dexterity caused by gloves and or cold conditions.

The upper ski strap 60 has a central male clasp 63 that mates or connects into a complimentary female clasp 65. An "O" or "D" ring 64 is positioned between the male 63 and the female 65 clasps. The ring 64 allows for connection of one of the operable clasps 54 or 55 on the sling strap 50. A free end 62 of the strap 61 allows for a user to grasp to tighten a grip on skies placed in the strap between the male 63 and the female 65 clasps. The strap 60 can also include an alarm, combination lock or other anti-theft device 66. It is also contemplated that the male 63 and female clasps 65 can include a key lock or a combination lock.

The ski pouch 80 is essentially a pouch with an opening where the flat portion of the skies are placed to secure the flat end of the skies. The ski pouch 80 has a top flap that wraps around the opening to secure any contents within the pouch. The ski pouch 80 is shown with the lower ski strap components 90 and 100 secured to the ski pouch 80.

The lower pole strap components 90 and 100 are snapped 93 and 103 onto the ski pouch 80. Lower pole strap component 90 has a snap 93 at a first end with a male clasp 94 and a free length of strap material 91 with a buckle 92. A "D" ring 95 is secured to the front flap of the ski pouch 80. The lower pole strap component 100 also snaps to the ski pouch 80 and has a female buckle 101. While snaps are one preferred closure embodiment, other closure types are contemplated, including but not limited to, hook and loop, magnetic closure, slots and rotating clasps.

An alternate embodiment of the straps is shown with the strap having an elongated central section 30 with an S-biner having two clip areas 32 and 33. The other end of the strap 30 has a turnbuckle with a clasp 31. Another contemplated retaining device is the strap with a ratchet clamp 97 that ratchets against the one-way teeth 96 to tighten and retain the strap 90 on skies. This strap has a "D" ring 98.

Figure 3:
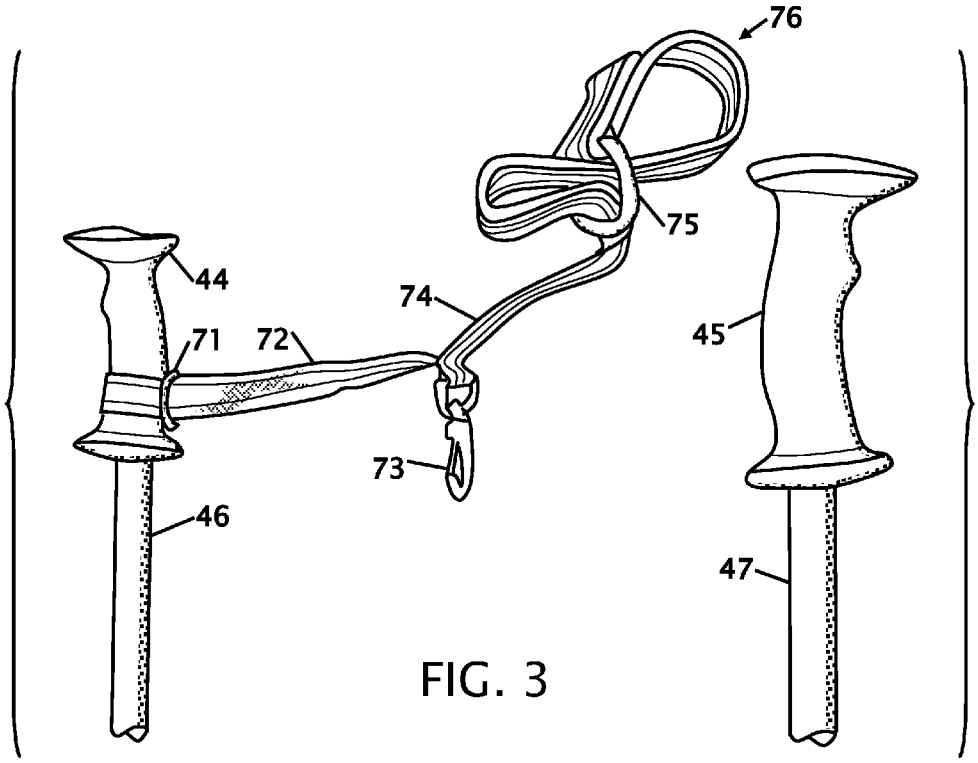
FIG. 3 shows a view of the attachment of the ski poles.

FIG. 3 shows a view of the attachment of the ski poles 46 and 47. The ski poles 46 and 47 are secured by using the pole strap 30 that has two lengths of strap material 72 and 74 with an operable clasp 73 located at an equal distance between two separate "D" ring 71 and 75. To install the ski poles 46 and 47 onto the pole strap 30 a portion of the strap material, 72 or 74 is looped 76 and passed through the respective "D" ring 71 or 75 and the hand grip 44 or 45 of the ski pole is passed through the loop. The loop is then tightened to secure the hand grip 45 of the ski pole.

Figure 4:
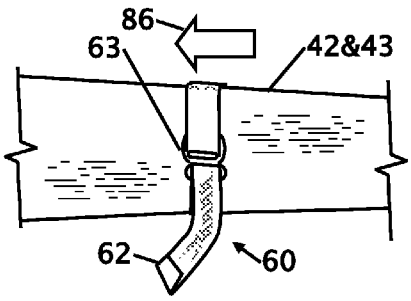
FIG. 4 shows the top of the skies being secured.

FIG. 4 shows the top of the skies being secured. Because current skies 42 & 43 are parabolic in shape, the upper ski strap 60 can be secured at a narrow portion of the skies 42 & 43. The free end 62 of the strap 60 can be pulled to tighten the strap 60 in the buckle 63 and then moved 86 up to the wider portion of the skies 42 & 43 to increase the binding of the strap 60 on the skies 42 & 43.

Figure 5:
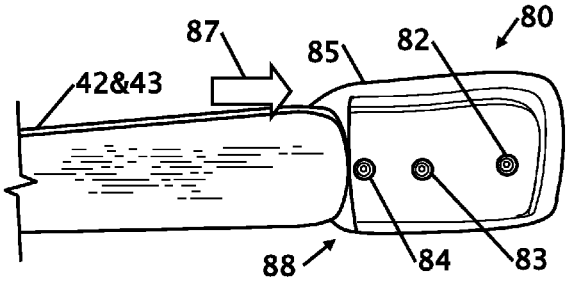
FIG. 5 shows the bottom of the skies entering the pouch.

FIG. 5 shows the bottom of the skies 42 & 43 entering 87 into the open 88 end of the pouch 80. A backing lip 85 extends around the back of the pocket to provide a flat surface that sits on the flat surface of the ski. The end of the skies 42 & 43 are then seated into the pocket 80. The flap portion 85 of the pocket 80 is brought along the back side of the skies 42 & 43. The ski pouch 80 has a number of snaps 82, 83 and 84 for securing some of the straps, in particular the lower pole strap 90/100 that wraps around the pouch 80 and previously shown.

Figure 6:
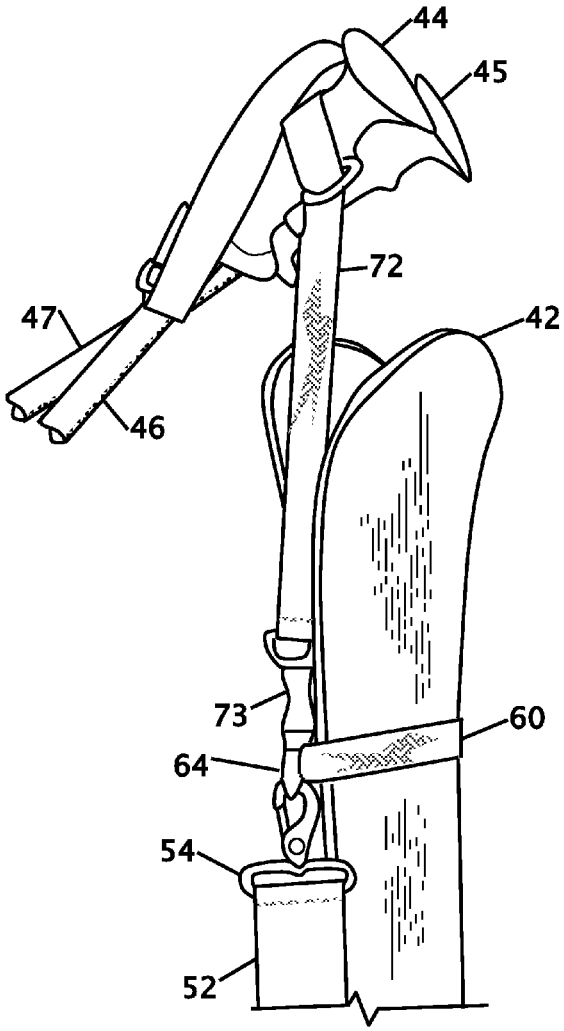
FIG. 6 shows the top of the poles being secured to the skies.

FIG. 6 shows the top of the poles 46 and 47 being secured to the skies 42. The ski poles 46 and 47 have hand grips 44 and 45 respectively where the upper pole strap 72 is secured. The clasp 73 in the center of the pole strap 72 is secured to the ring 64 on the upper ski strap 60 and then the upper pole strap 72 is brought between the curved tips of the skies for stability. The clasp 54 on the lower sling strap 52 is also connected to the ring 64 on the upper strap 60. It is important for the ring 64 to be positioned at the side of the skies to allow the apparatus to be slung diagonally across the back of a user.

Figure 7:
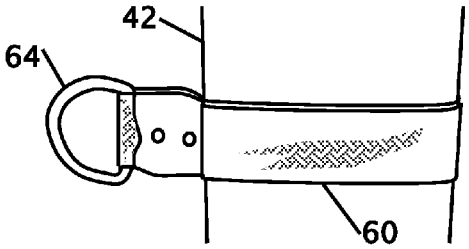
FIG. 7 shows positioning the D-ring on the bound skies.

FIG. 7 shows positioning the D-ring 64 on the bound skies 42. The strap 60 holds the skies 42 tightly together. The strap is installed and tightened on the skies 42 such that the D-ring 64 is positioned on the side of the skies 42. This allows the skies to be strapped over the back of the user and reduces the edges of the skies being in contact with the user.

Figure 8:
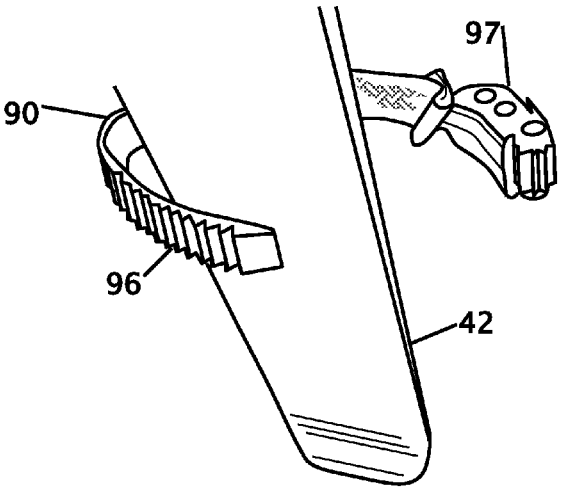
FIG. 8 shows securing the adjustable binding strap on the skies.

FIG. 8 shows securing the adjustable binding strap 90 on the skies 42. This binding strap 90 has a plurality of saw tooth teeth 96. The teeth 96 engage into a ratcheting mechanism 97 that pulls on the teeth 96 to tighten the strap 90 onto the skies 42 to hold the skies within the strap 90.

Figure 9:
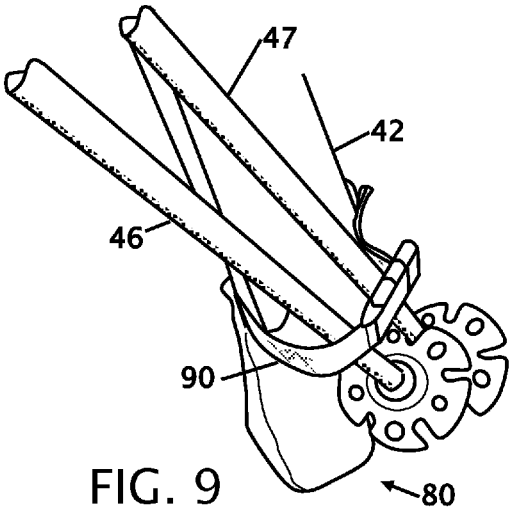
FIG. 9 shows one embodiment of binding the bottom of the skies.

FIG. 9 shows one embodiment of binding the bottom of the skies 42 with ski poles 46 and 47. The skies 42 are shown with securing strap 90 within the storage pouch 80. The strap 90 secures the skies 42 and the poles 46, 47 as a collective group.

Figure 10:
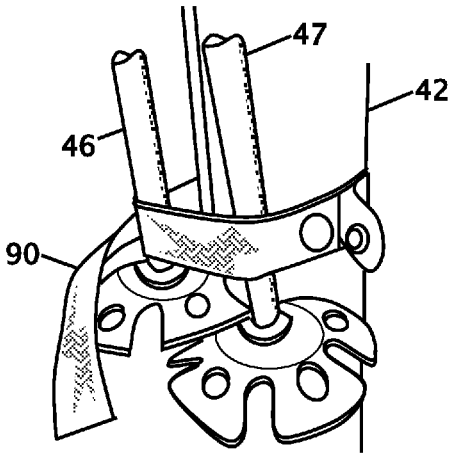
FIG. 10 shows the bottom of the poles being secured to the skies.

FIG. 10 shows the bottom of the poles being secured to the skies. At this location the end of the ski poles 46 and 47 are shown secured to the bottom straight end of the skies 42. The lower straps 90/100 secure all the skies and poles together to prevent undesirable movement while they are being transported.

Figure 11:
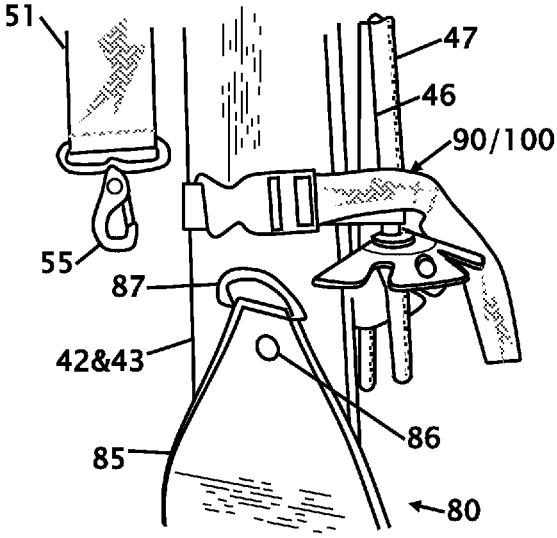
FIG. 11 shows pouch being secured to the opposing side of the sling.

FIG. 11 shows pouch being secured to the opposing side of the sling strap 51. The lower end 51 of the sling strap has a clasp 55 that connects to the "D" ring 87 on the flap 85 of the pouch 80. The flat end of the skies 42 and 43 are shown in the pouch 80. The snap 86 can be secured to one of the snaps 86 on the front of the pouch 80. While snaps are one preferred closure embodiment, other closure types are contemplated, including but not limited to, hook and loop, magnetic closure, slots and rotating clasps.

The ski poles 46 and 47 are shown secured to the skies 42 and 43 with the lower ski and pole strap 90/100 is wrapped around both the skies and both of the poles. Once both ends of the sling strap 50 have been secured with the clasp 54 in the "D" ring 64 (at the other end of strap 51) and the "D" ring 87 with clasp 55 of the ski pouch 80, the user can place the sling 50 over their head and shoulder. Once the user is wearing the sling, the user can adjust the length of the sling 50 to set the preferred location of the sling on the user. To quickly remove the sling, a user can unbuckle the clasp or buckle 53 in the sling 50.

Figure 12:
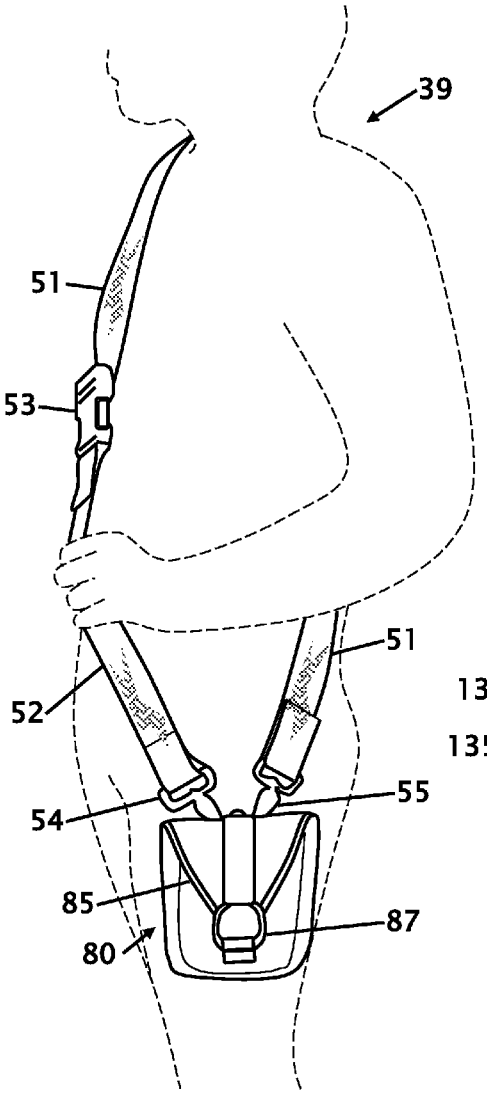
FIG. 12 shows the pouch secured over a shoulder of a user.

FIG. 12 shows the pouch 80 secured over a shoulder of a user 39. When the pouch 80 is not being used to transport ski equipment, the remaining straps are placed into the pouch 80. This view shows the clasp 53 of the sling 51 and 52. The clasps 54 and 55 are secured to "D" ring on the back of the pouch 80. The front flap 85 of the pouch 80 is brought over the pouch 80 where the "D" ring 87 is held by the straps.

Figure 13:
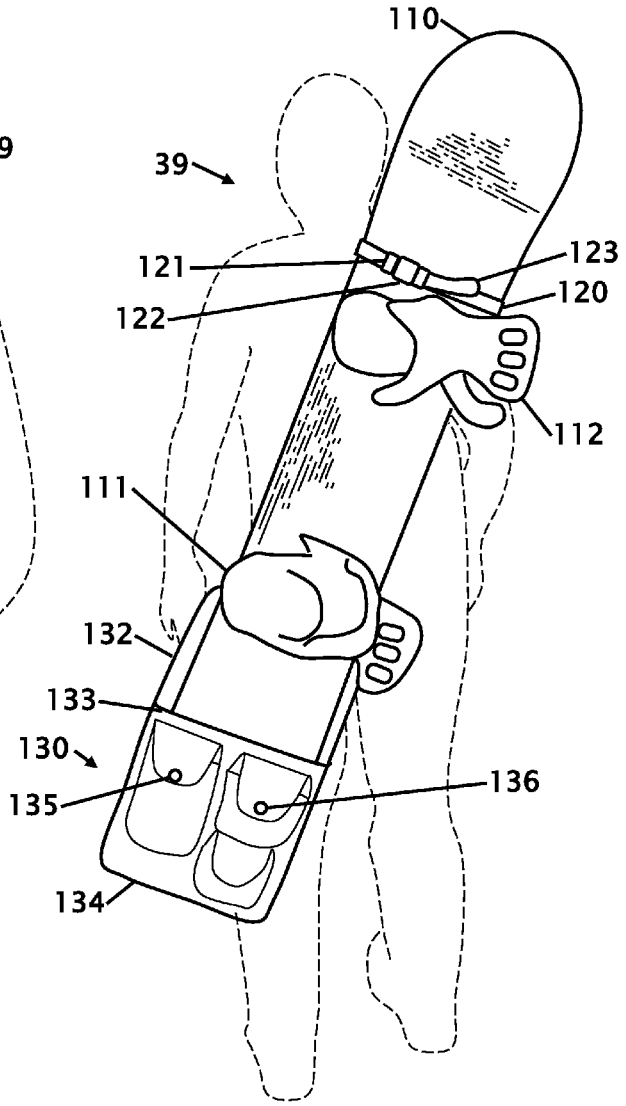
FIG. 13 shows a sling carrier with a snowboard and snowboard boots.

FIG. 13 shows a sling carrier with a snowboard 110 and snowboard boots 111 and 112. The snowboard 110, boots or boot bindings 111 and 112 are all carried on the back of the user 39 in a sling arrangement that allows the person 39 to easily walk and bend over because the equipment is distributed and balanced on the back of the user 39. This further frees the hands of the user to pay for lift tickets or carry other items. The bottom of the snowboard 110 is held in a pocket 133 within a pouch 130. The pouch 130 has a surrounding lip 134 with a raised front surface where the snowboard 110 fits inside of the pouch 130. The front of the pouch 130 has some pockets with mechanical or magnetic snaps 135 and 136 for securing the pockets. A sling strap (not visible in this figure) connects from the pouch 130 to an upper strap 120.

The upper strap 120 wraps around the upper portion of the snowboard 110 to secure the snowboard 110. The upper strap has a male 121 and a female 122 buckle portion secured on the strap 120. The "O" or "D" ring 122 is placed in the center of the width of the snowboard. An end 123 of the strap 120 allows for tightening or loosening of the strap 120 on the snowboard 110.

Figure 14:
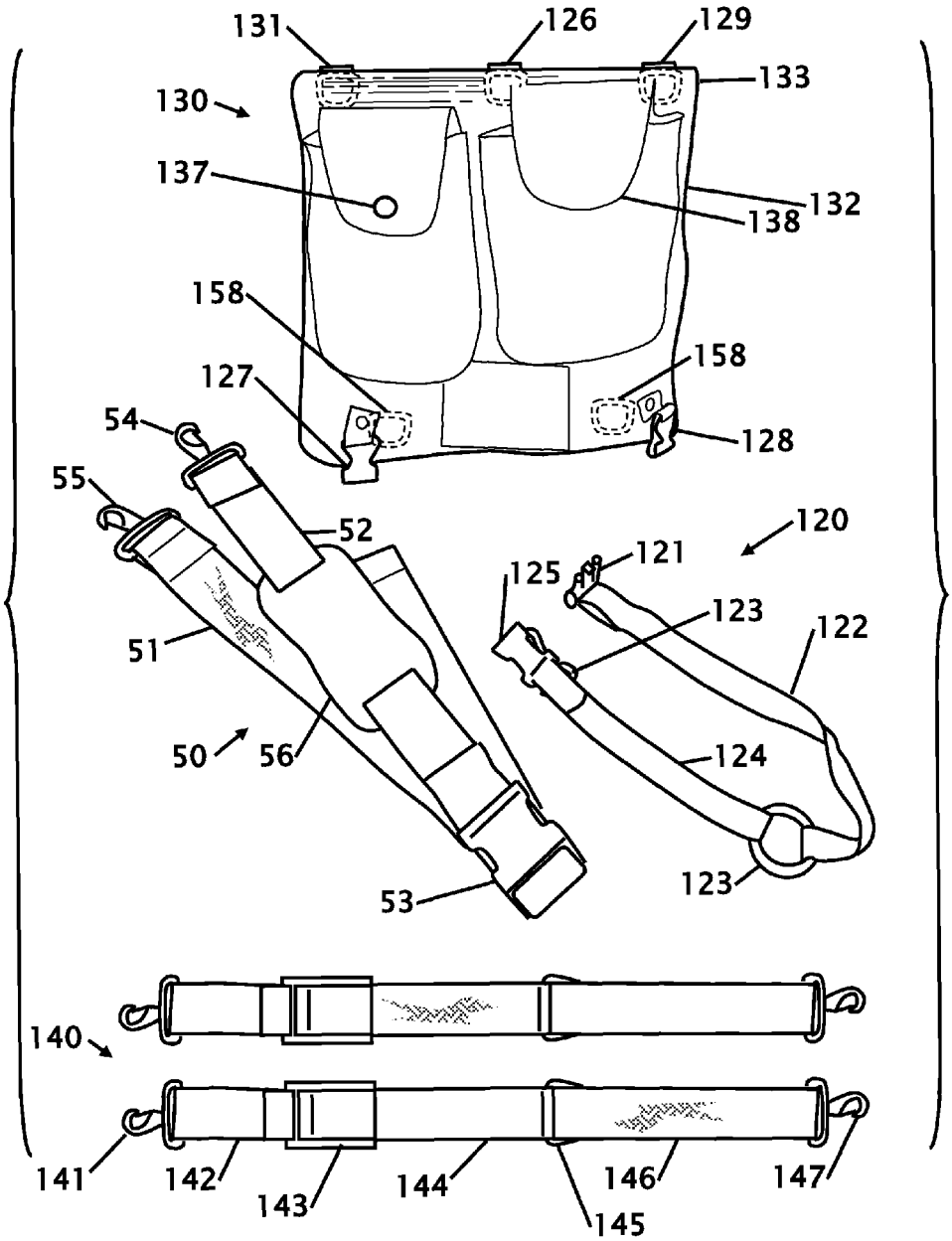
FIG. 14 shows the components used in the sling carrier for a snowboard.

FIG. 14 shows the components used in the sling carrier for a snowboard. The sling strap 50 has a separable buckle 53 with a male and a female clasp that allows a user to separate the two parts, 51 and 52, of the sling strap 50. The separable buckle 53 further includes an adjustment mechanism to alter the overall length of the sling strap to fit the geometry of a user to adjust the location of the equipment on the back of a user. An adjustable pad 56 is present on the strap 52 to provide a cushion and to distribute loads on the strap 50. On the opposing sides of the buckle 53 there are separate lengths of straps 51 and 52. Each of these lengths of straps terminate with operable clasps 54 and 55. The clasps 54 and 55, along with the buckle 53 are designed to allow an operator to connect and disconnect the components in freezing condition and with limited dexterity caused by gloves and or cold conditions.

The pouch 130 is configured with a square or rounded bottom to accept either end of a snowboard. The pouch 130 has a front flap 132 that closes over a pocket opening 133 where an end of a snowboard is secured therein. The flap has a "D" ring at the front of the flap for securing one end 55 of the sling strap 50. Mechanical or magnetic snaps 137 and 138 secure the flap 132 to the front of the pouch 130. A plurality of "D" rings and clasps 127, 128 and 129 are located on the front and back of the pouch 130 for converting the pouch into a backpack for storage of the straps and or other personal items.

An upper snowboard strap 120 is configured to wrap around the snowboard. The inside of the upper snowboard strap 120 is reinforced or backed with leather or other equivalent material to protect the strap material from being damaged from the hard sharp edges of the snowboard. This strap 120 has a male connector 121 and a female connector 125 at opposing ends. The tail 123 can be pulled to tighten the strap 120 on the snowboard. Between the male 121 and the female 125 connectors an "O" or "D" ring is located between the strap portions 122 and 124. The "O" or "D" ring is used to connect to the other clasp 55 on the opposing end of the sling strap 50. Two additional strap members 140 are used to transport the pouch 130 as a backpack.

The strap members 140 are essentially the same. The straps 140 include clasps 141 and 147 on each end of the strap. The strap 140 has three section 142, 144 and 146. Between section 144 and 146 a "D" ring 145 is located for securing the end of the strap 144. An adjustable buckle 143 is located to adjust the overall length of the strap 140.

Figure 15:
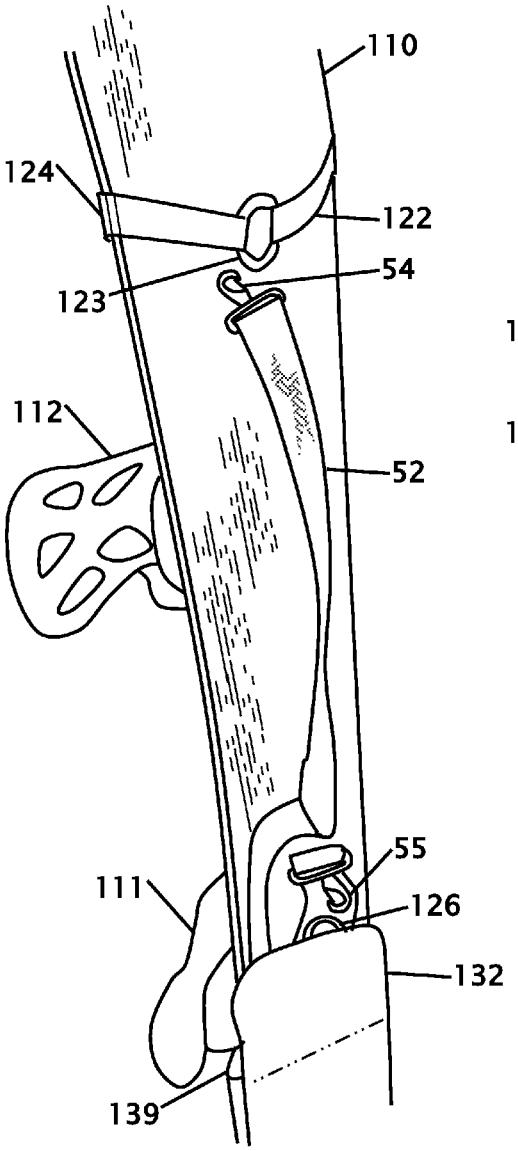
FIG. 15 shows a snowboard being secured into the pouch and the sling.

FIG. 15 shows a snowboard being secured into the pouch and the sling. First the upper strap is secured around the snowboard 110 and then buckle at the end of strap portions 122 and 124 is connected. The strap is tightened onto the snowboard 110 at a position above the top boot binding.

When the top strap is attached, the "O" or "D" ring 123 is centered in the middle of the base width wise. Snowboards also have a parabolic shape. The method for attaching the top strap 122 is to clip it around the board just above the leading (top) binding, pull the adjuster strap down nice and snug making sure the "O" or "D" 123 is centered on the base, the strap is moved up until the strap reaches the widest part of the parabolic shape making a nice and tight strap on the snowboard.

The bottom of the snowboard is slid into the pouch opening 139 to a position below the lower binding 111. The top flap 132 is lifted to allow the clip 55 of the sling strap to connect to the "D" loop 126. The other end of the sling strap 52 is then hooked 54 into the "O" or "D" ring 123 of the upper strap. The user can then enter into the sling strap and tighten the sling strap for the desired fit. When the board is being transported, the top strap will come into contact with the edges as it is positioned on the base. Those edges can be extremely sharp and would probably cut right through a standard nylon strap. As with the ski sling, the central buckle on the sling strap is disconnected to quickly exit from the snowboard sling carrier.

Figure 16:
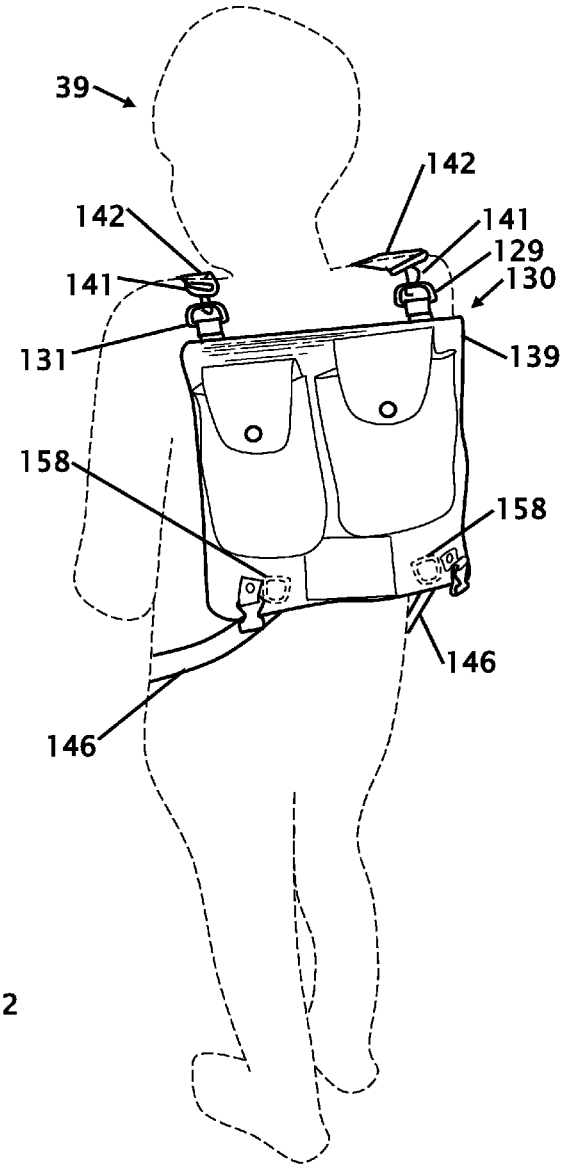
FIG. 16 shows the snowboard pouch being carried on the back of a user.

FIG. 16 shows the snowboard pouch being carried on the back of a user. When the snowboard carrier is not being used to transport the snowboard the pouch 130 can be used as a backpack. The strap members 142 are connected to the "D" ring 129 at the top of the carrier and also connected to "D" rings 158 (obscured in this view) on the back of the carrier 130. The straps 140 can then be adjusted to the desired fit based upon the desires of the user or the physical features of the user 39.

Figure 17:
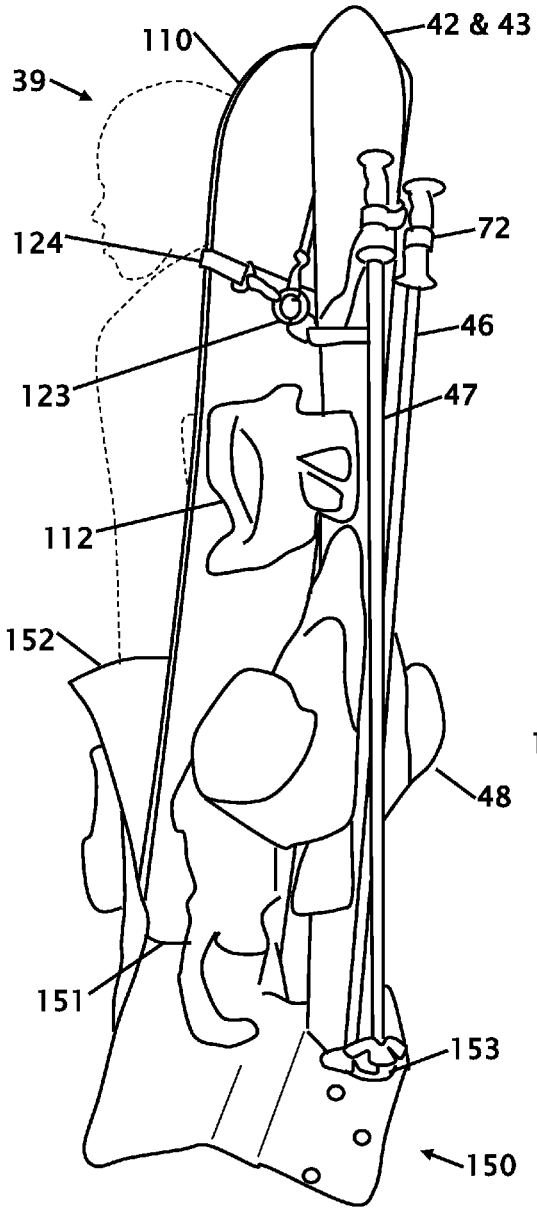
FIG. 17 shows a sling carrier for skis, snowboard and boots.

FIG. 17 shows a sling carrier for skis, snowboard and boots. In this embodiment a user 39 is able to carry all of the ski and snowboard equipment with a single sling carrier. The hands of the user remain free. The majority of the components have been shown and described in previous embodiments shown and described herein with the exception of the pouch 150. The pouch has two pockets, a first pocket 151 where the snowboard 110 is inserted and a second pouch 153 where the flat ends of the skies are inserted, and the ends of the ski poles 46 and 47 are retained. The pocket 153 for the skies 42 & 43 essentially folds out perpendicular to the pocket 151 that retains the snowboard 110. A flap 152 covers the ski retaining pocket 153 when the pocket is not being used.

Figure 18:
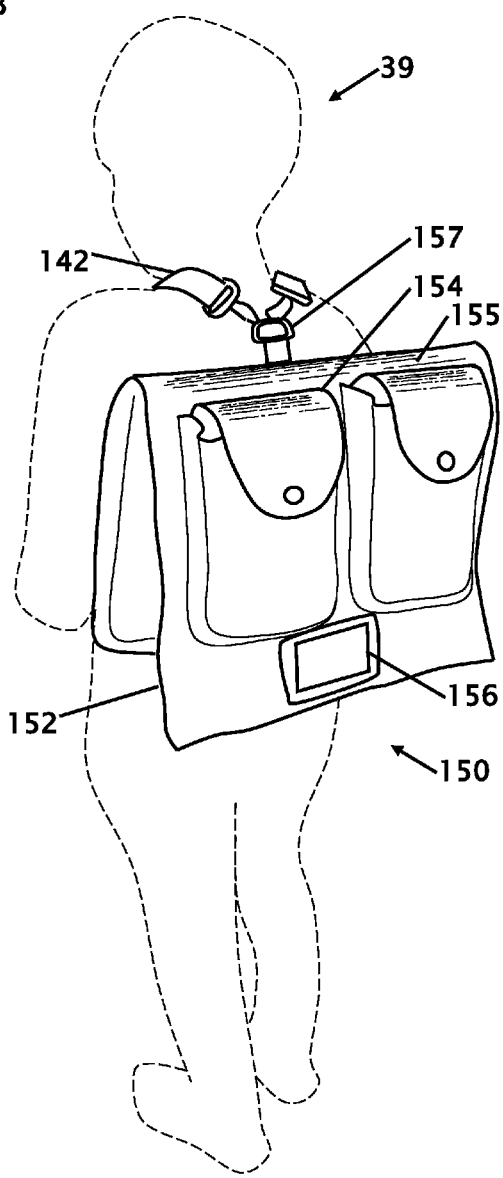
FIG. 18 shows the carrier without the ski equipment being carried as a backpack.

FIG. 18 shows the carrier without the ski and snowboard equipment being carried as a backpack. This figure shows the other side of the flap 152 with storage pockets 154 and 155 for storage of the securing straps. The back of the flap 152 further includes a transparent window 156 for storage of a license, lift ticket etc.

When the carrier 150 is not being used to transport the skies and or snowboard the pouch 150 can be used as a backpack. The strap members 142 are connected to the "D" ring 157 at the top of the carrier and also connected to "D" rings (obscured in this view) on the back of the carrier 150. The straps can then be adjusted to the desired fit based upon the desires of the user or the physical features of the user 39.

Figure 19:
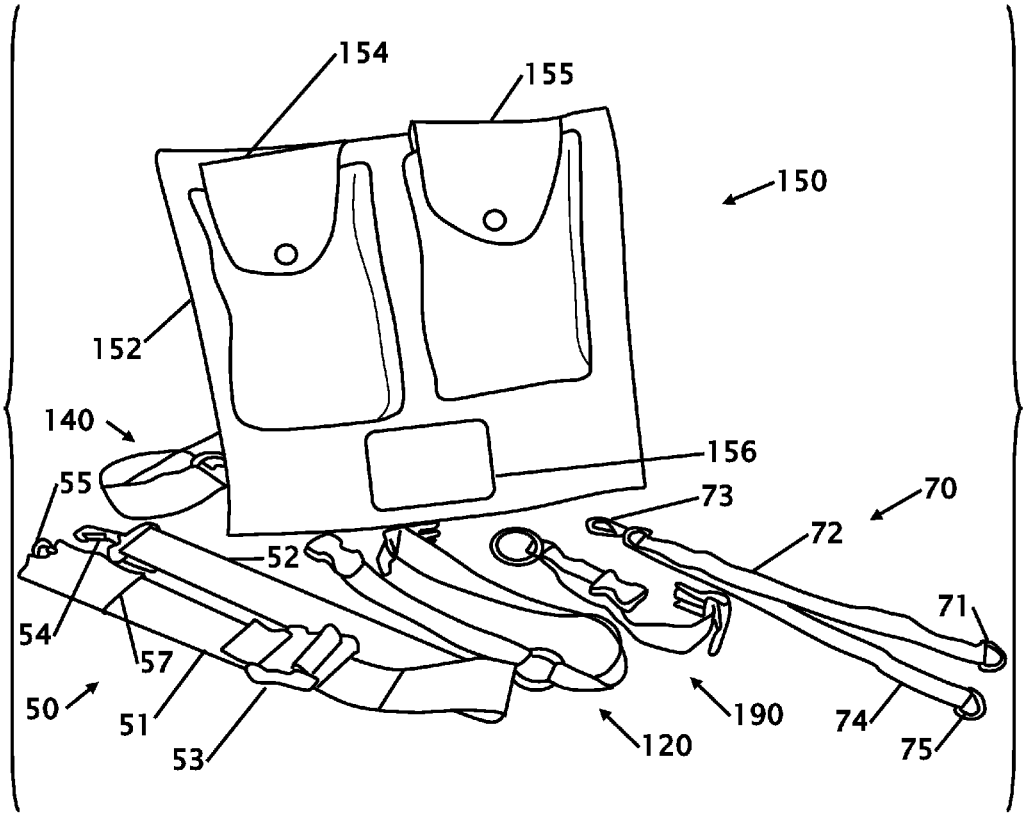
FIG. 19 shows the components used to carry skies and a snowboard.

FIG. 19 shows the components used to carry skies and a snowboard. The straps 50, 30, 120, 140 and 190 are essentially the same as previously described. Strap 50 includes a protective sleeve 57 to reduce abrasion of the clasp 54. Strap 190 is essentially the same as strap 120 with a slight difference in the length of the strap and strap 120 further has an additional clip that is adjacent to the female part of the buckle. The clip is secured to the upper ski strap 190.

To assemble the skis within this storage version the curved ends of the skies are bound as previously described and the grip ends of the ski poles are bound as previously identified.

Figure 20:
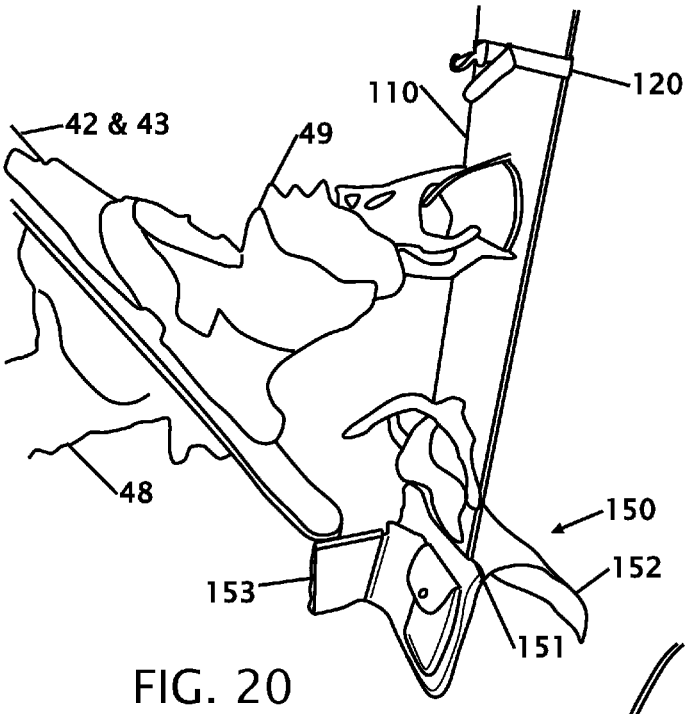
FIG. 20 shows the snowboard in the pouch with the skies being inserted.

FIG. 20 shows the snowboard in the pouch with the skies being inserted. The strap 120 is secured to the snowboard 110 as previously described. The snowboard 110 is inserted into the pocket 151 of the pouch 150. An inner pocket 153 is exposed from the pouch 150 and the flat end of the skies are inserted into the inner pocket 153. The skies 42 and 43 are elevated, essentially parallel to the snowboard 110.

Figure 21:
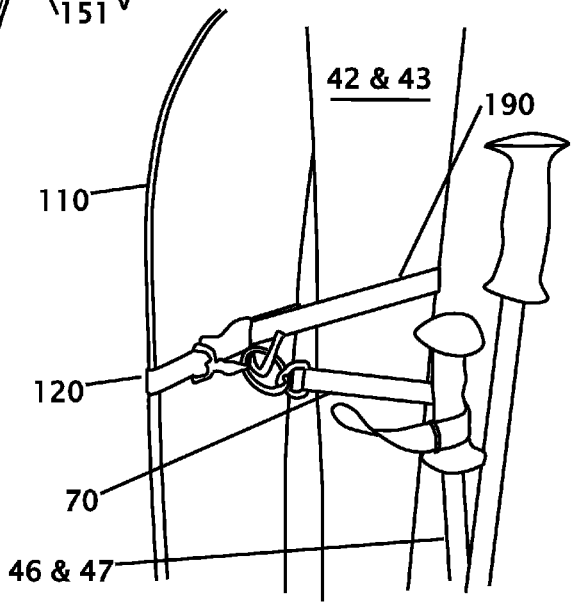
FIG. 21 shows the top end of the poles being secured to the skies and snowboard.

FIG. 21 shows the top end of the poles being secured to the skies 42 & 43 and snowboard 110. In this figure the strap 30 that retains the ski poles 46 & 47 are secured to the "D" ring of strap 190. The "D" ring of strap 190 is connected to clip that is adjacent to the female buckle. The free end of the ski poles are the tucked into the pocket 153. The sling strap 50 is secured to strap 120 and to the pouch 150 to allow a user to lift all the equipment onto their back for transportation.

While specific materials of leather, nylon and "O" or "D" rings and buckles have been identified in the application, it should be obvious to one skilled in the art that future progression of the carriers can include alternative materials and construction that provide the same or superior functionality.

Thus, specific embodiments of a sling carrier for skis, snowboard and boots has been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A sling carrier for skis, snowboard and boots comprising:

a first securing strap for securing a first end of two snow skies;

a second securing strap for securing a first end of two ski poles;

said second securing strap has "O" or "D" rings on distal ends of said second securing strap and a clasp on said second securing strap between said "O" or "D" rings;

a third securing strap for securing a first end of a snowboard;

said third securing strap includes at least one ring for securing said first securing strap and said second securing strap to said ring;

a pouch having a first pocket for securing a second end of said snowboard and a second pocket for securing said two skies at said second end of said two skies, and a fourth securing strap that extends from said pouch to said first securing strap.

2. The sling carrier for skis, snowboard and boots according to claim 1 wherein said first securing strap has a male and a female buckle.

3. The sling carrier for skis, snowboard and boots according to claim 1 wherein said third securing strap has a male and a female buckle.

4. The sling carrier for skis, snowboard and boots according to claim 1 wherein said fourth securing strap has a male and a female buckle that further includes a key lock or a combination lock.

5. The sling carrier for skis, snowboard and boots according to claim 1 wherein when a user slings said sling carrier on a back of said user, hands and arms of said user are not used to carry said skies, snowboard, ski poles or boots.

6. A sling carrier for skis and ski boots comprising:

a first securing strap for securing a first end of two snow skies;

a second securing strap for securing a first end of two ski poles;

said second securing strap has "O" or "D" rings on distal ends of said second securing strap and a clasp on said second securing strap between said "O" or "D" rings;

a third securing strap for securing said two skies and said two ski poles at a second end of said two skies and said two ski poles;

a pouch for securing said two skies at said second end of said two skies, and a fourth securing strap that extends from said pouch to said first securing strap and said fourth securing strap has a male and a female buckle that further includes a key lock or a combination lock.

7. The sling carrier for skis and ski boots according to claim 6 wherein said first securing strap has a male and a female buckle.

8. The sling carrier for skis and ski boots according to claim 6 wherein said third securing strap has a male and a female buckle.

9. The sling carrier for skis and ski boots according to claim 6 wherein said pouch stores said first securing strap, and said second securing strap therein.

10. The sling carrier for skis and ski boots according to claim 6 wherein when a user slings said sling carrier on a back of said user, hands and arms of said user are not used to carry said skies, ski poles or boots.

* * * * *